US006042102A

United States Patent [19]

Raschke et al.

[11] Patent Number: 6,042,102

[45] Date of Patent: Mar. 28, 2000

[54] APPARATUS FOR SEPARATING AND TRANSFERRING FLAT UNIT LOADS

[75] Inventors: Josef Raschke, Pliening; Rudolf Schuster, Kirchheim, both of Germany

[73] Assignee: Siemens Aktiengesellschaft, Munich, Germany

[21] Appl. No.: 08/836,237

[22] PCT Filed: Oct. 18, 1995

[86] PCT No.: PCT/DE95/01448

§ 371 Date: Apr. 28, 1997

§ 102(e) Date: Apr. 28, 1997

[87] PCT Pub. No.: WO96/13452

PCT Pub. Date: May 9, 1996

[30] Foreign Application Priority Data

Oct. 26, 1994 [DE] Germany ..... 44 38 313

[51] Int. Cl.[7] ..... B65H 5/22

[52] U.S. Cl. ..... 271/12; 271/96; 271/108; 271/225; 271/150

[58] Field of Search ..... 271/94, 96, 108, 271/11, 12, 225, 149, 150, 184, 185, 186; 270/58.33

[56] References Cited

U.S. PATENT DOCUMENTS

| | | | |
|---|---|---|---|
| 1,961,401 | 6/1934 | Steinmann | 271/94 |
| 3,148,876 | 9/1964 | Chandler et al. | 271/94 |
| 3,885,784 | 5/1975 | Sautton . | |
| 3,954,260 | 5/1976 | Morello et al. | 271/96 |
| 5,029,834 | 7/1991 | Boldrini et al. | 271/11 |
| 5,354,045 | 10/1994 | Boldrini et al. | 271/11 |
| 5,511,772 | 4/1996 | Ganz et al. | 271/108 |

FOREIGN PATENT DOCUMENTS

| | | |
|---|---|---|
| 19 17 795 | 11/1969 | Germany . |
| 664748 | 3/1988 | Switzerland . |

OTHER PUBLICATIONS

Search Report.

*Primary Examiner*—Boris Milef
*Assistant Examiner*—Patrick Mackey
*Attorney, Agent, or Firm*—Hill & Simpson

[57] ABSTRACT

An apparatus for separating and transferring flat unit loads such as newspapers, periodicals and other publications is disclosed. The apparatus has a means for accepting a stack of unit loads and for offering the unit loads one-by-one at a fetching position. A drum is arranged rotatable about a longitudinal axis and has a perimeter surface adjacent the fetching position. The drum has at least one suction opening formed in the perimeter surface for seizing the next available unit load from the stack at the fetching position and for holding the unit load to the drum perimeter surface as the drum rotates to an ejection position. A conveyor means is disposed adjacent the ejection position for receiving the separated unit load from the drum and for transporting the unit load away. The apparatus is also suitable for separating and transferring unpackaged newspapers, periodicals, other publications and the like.

11 Claims, 1 Drawing Sheet

APPARATUS FOR SEPARATING AND TRANSFERRING FLAT UNIT LOADS

BACKGROUND OF THE INVENTION

1. Field of the Invention

The present invention relates to load handling systems, and in particular to an apparatus for separating flat unit loads such as letters, newspapers, periodicals and the like and for delivering them to a conveying system.

2. Description of the Prior Art

Machine-readable postal zip-codes are indicated on mailings such as letters, postcards, packages and the like as an identifier for a location, a delivery area, a Post Office Box or a bulk recipient enabling fast distribution of the mail by machine. The sorting of the incoming mailings ensues, for example, with the assistance of controllable flat unit load carriers that are respectively loaded with a mail shipment in specific loading locations. The mail shipment is then delivered to a sorting container or a corresponding sorting compartment allocated to the respective postal zip-code. Since the sorting containers or sorting compartments can be arranged in various levels, the flat unit load carriers circulating at conveyor devices must also be potentially able to bridge different height levels.

After the transfer of the mail shipment to the allocated sorting container or the allocated sorting compartment, the empty flat unit load carriers can be reloaded with another mail shipment when passing a loading location. For example, the loading of the flat unit load carriers ensues with the assistance of a circulating impeller wheel whose blades form cells that accept the flat unit loads that are already separated and incoming on a conveyor means and deliver them to the circulating flat unit load carriers. The separation and the transfer of the flat unit loads to the conveyor means leading to the impeller wheel must thereby be undertaken with a relatively high precision matched to the processing speed of the overall sorting means.

Comparable sorting jobs also derive in what is referred to as the remission of periodicals, newspapers or other such publications. The publications not sold by individual dealers are returned to the wholesaler where the publications are sorted out for disposal or are sorted anew for being returned to the respective publisher.

The automatic handling and, in particular, the separation of unpackaged periodicals or newspapers presents considerable difficulties both in the distribution of postal matter as well as in the remission of the publications. When handling the publications with automatic gripping devices, several problems may arise. The publications may open, causing damage or destruction of the publication. These problems may further lead to an interruption of the overall sorting process.

German OS 1 917 795 discloses a conveyor means for page-shaped objects, which means operate with suction air. A stack of objects is moved in a horizontal direction with vertically oriented objects and is brought to a transport drum provided with suction air openings. A removal drum is located above the transport drum. The transport drum pulls the objects from the stack directly upward to the removal drum.

Further, Swiss Patent Publication No. 664748 discloses a device for separating sheets that are brought from a stack to a transport drum from above and that are transported directly to a laterally arranged deflection means by the transport drum.

SUMMARY OF THE INVENTION

The invention is a device for separating and for transferring flat unit loads, which device works rapidly and reliably. The invention requires relatively little outlay and, therefore, helps assure a reliable handling of periodicals, newspapers, catalogs and the like.

The inventive device can be utilized in the remission or separation of periodicals or newspapers in public Post Offices or in the central mailrooms of large companies. Over and above this, the inventive device, however, can also be utilized, for example, in warehousing systems or automatic commissioning units for comparable tasks or where flat, stackable unit loads are to be separated and transferred to a conveyor means.

The invention is based on the perception that the rotational motion of a drum provided with a suction opening or a plurality of suction openings is very well-suited for the separation and for the transfer of periodicals, newspapers and the like. When the spine or fold of the periodicals is located at the back or trailing edge with respect to the rotational direction of the drum, then publications that are not bound are also held together and loose inserts that may also be potentially present cannot fall out.

The separating is promoted by the erect position or vertical orientation of the unit load since the unit load offered in the fetching position is pulled from the horizontal stack in an upward direction. The next unit load opposes the haul-off force with a force provided by the dead weight of the forward leaning horizontal stack. Since the unit load need not be pulled off against an edge, a separation of unit loads with different thicknesses is also enabled.

The transfer of the unit load to the conveyor means utilizes gravity and is facilitated by the arrangement of the conveyor means under the fetching position. The guide means is timed to assure that the unit load can be placed onto the conveyor means exactly guided and exactly clocked on the longer conveying path over the upper side of the drum.

In one embodiment, the invention enables a horizontally oriented delivery of a stack of unit loads to be separated. The offering or delivery of the unit loads on a belt conveyor may be realized with substantially less structural outlay than is required for conventional magazines.

In another embodiment, the invention leads to a further facilitation of unit load delivery by horizontally aligning the belt conveyor. A stable attitude of the entire stack is assured due to a forward slant of the stack toward the drum.

In another embodiment, the drum of the invention includes reciprocable rejectors, enabling an intentional entrainment of the next unit load offered in the fetching position at the desired time.

In an additional embodiment, the invention facilitates reliable guidance of the unit load between the fetching position and ejection position, whereby the guidance is facilitated with an endless circulating belt adjacent a portion of the drum.

In a further embodiment, the invention may include a sensing system enabling the apparatus to be adapted for separating and transferring unit loads onto a predetermined division or segment of the conveyor means that accepts the unit loads. This is done by controlling the rotational speed of the drum relative to the linear speed of the conveyor means. For example, two or more devices of the invention may be used to supply unit loads to the single conveyor means. The speed of the drum may be controlled to either uniformly or non-uniformly distribute unit loads onto the conveyor means.

In another embodiment, the invention may include two or more suction openings distributed over the circumference of the drum to produce two or more separations and transfers per revolution of the drum.

In a further embodiment, the invention may incorporate a sensing system to compensate for slippage potentially occurring between the unit load and the drum or guide means as the drum entrains and transfers the unit loads.

DESCRIPTION OF THE PREFERRED EMBODIMENTS

Figure 1:
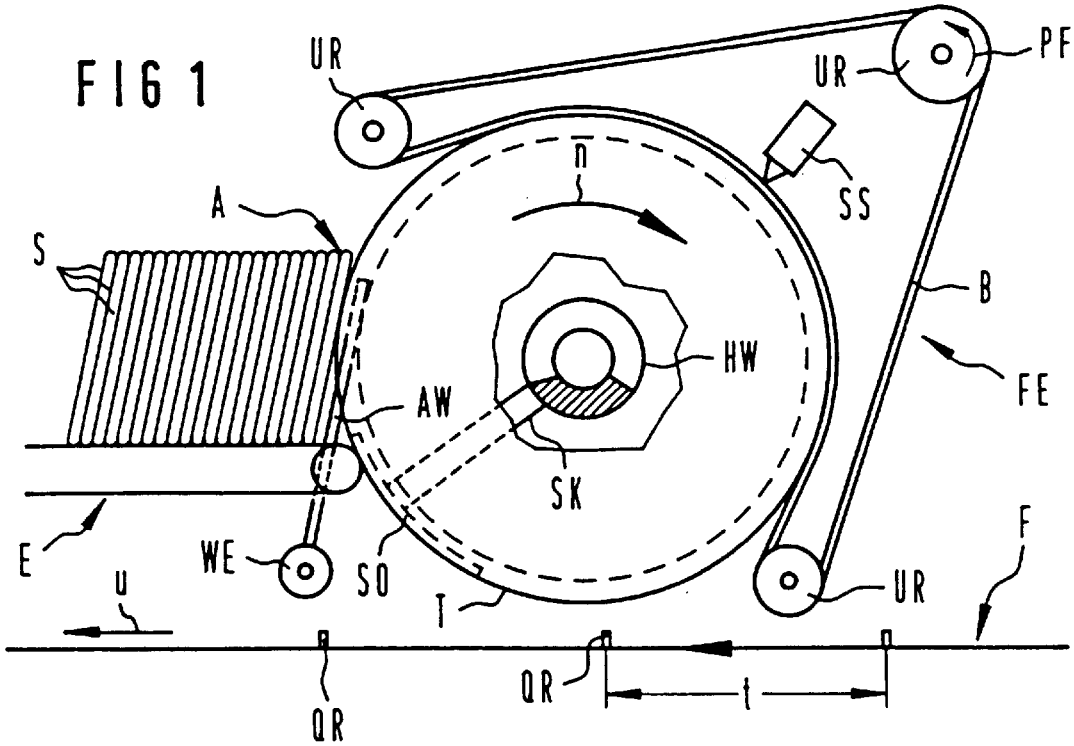
FIG. 1 is a side view of a device according to the invention for separating and for transferring flat unit loads wherein a portion is shown partially cut-away and in cross section.
Figure 2:
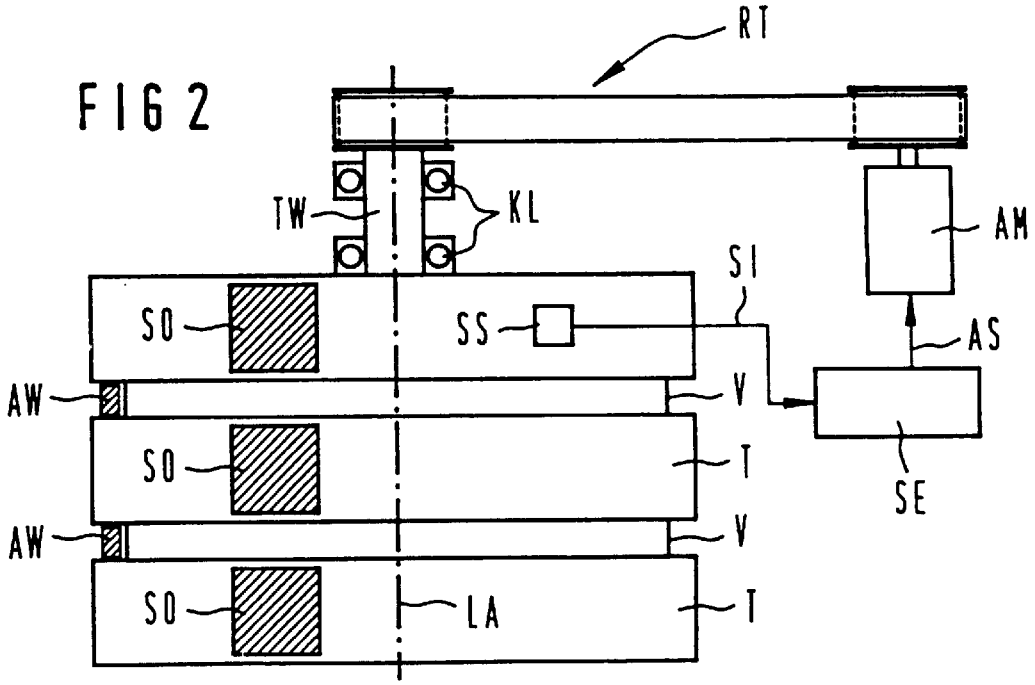
FIG. 2 is a plan view of a portion of the device of FIG. 1.

In highly simplified, schematic illustrations, FIG. 1 is a side view and FIG. 2 is a plan view of a device for separating and for transferring unit loads S, such as newspapers, periodicals or other publications, to a conveyor means F. A first means E is provided for the acceptance of the unit load S present here in the form of periodicals or newspapers having different formats and different weights and for offering this unit load S in a front fetching position A. This first means E—which is not shown in FIG. 2—is shown as a horizontally aligned belt conveyor that can be driven step-by-step in the direction toward the fetching position A. The unit load S is placed, by hand, in stacks on the conveyor belt where each individual publication is oriented erect or vertically and inclined slightly toward a drum T.

The drum T, which is arranged rotatable around a longitudinal axis LA, is disposed adjacent the fetching position A of the first means E and above the conveyor means F for grasping the unit load S offered at the fetching position A. To accomplish this, the drum T has a total of three suction openings SO (FIG. 2) formed next to one another in a perimeter surface. Each of the suction openings SO can be connected via radial suction channels SK (FIG. 1) with the drum to the interior of a hollow shaft or axle HW on which the drum T turns. The inside of the hollow shaft HW is in turn connected to a vacuum source (not shown in detail in the drawing). As a result of a segmented opening VO (FIG. 1) in the hollow shaft HW for each of the suction channels SK, a type of rotary slide valve is produced. The suction openings SO communicate via the openings VO with the vacuum source when they reach the fetching position A. The unit load S offered in the fetching position A is thus seized by the drum T as a result of the suction effect of the suction openings SO and is pulled slightly obliquely upward from the remaining stack in the tangential direction of the drum T. After a rotation of the drum T of, for example, more than 180° and less than 270°, a closed portion C of the hollow shaft HW interrupts the connection of the suction openings SO to the vacuum source, and the separated unit load S is thrown or dropped onto the conveyor means F.

The unit loads or publications are preferably placed on the conveyor belt of means E with the spine or fold placed on top of the belt and the publications opening upward, although a reverse orientation is possible. The unit loads are inclined slightly toward the fetching position A and toward the drum. The forwardmost unit load S can be restrained from coming into contact with the drum by two reciprocable rejectors or stops AW arranged spaced at a distance from one another. When the forwardmost unit load S is offered at the fetching position A to be seized via the suction openings SO, the two rejectors or stops AW are retracted into corresponding and circumferential channel-like depressions V on the perimeter surface of the drum T. The rejectors or stops AW are secured on a shaft WE and their retraction and extension ensues as a result of corresponding rotation of the shaft WE.

A guide means FE for the unit load S is allocated to and cooperates with the drum T in the region between the fetching position A and the location for the ejection of the unit load S onto the conveyor means F. This guide means FE is formed by an endlessly circulating belt B that is guided over three deflection rollers UR. A portion of the belt B wraps the drum T in the desired guide region. The running direction of the belt B is shown with an arrow PF in FIG. 1, and the portion of the belt adjacent the drum travels in the same direction as the drum rotation. The belt B can be driven externally via the rollers UR or, on the other hand, can also be entrained via friction by the drum T, which is rotating at the speed n.

The belt B, shown only in FIG. 1, is subdivided into a plurality of straps proceeding parallel to one another, where a strap is provided for each segment of the drum having a suction opening. An optical sensor SS can thus be arranged in the region between the three deflection rollers UR. This optical sensor SS will detect the start and/or end of the respective unit load S entrained by the drum T at this location between two straps. It may be seen from FIG. 2 that the signal SI of the sensor SS is supplied to a control means SE. This control means SE in turn may influence a drive motor AM via an output signal AS. The drive motor AM may drive the drum shaft TW via a belt drive RT. The bearing of the drum shaft TW is indicated with ball bearings KL in FIG. 2.

The sensor SS thus determines or senses the position of the unit load S on the drum T, which load is seized by the suction openings SO. A slippage potentially identified by the sensor SS of a unit load S seized and entrained can thus be compensated for via the control means SE by a corresponding variation of the speed of rotation of the drum T.

In the illustrated exemplary embodiment, the conveyor means F accepting the separated unit load S in the form of a belt conveyor whose conveyor belt (not referenced in detail) moves with the speed u in the conveying direction. Cross or transverse ribs QR on the conveyor belt create a division t for the acceptance and further transport of the unit load S. The speed u of the conveyor means F and the speed n of the drum T are matched relative to one another so that a transfer of the unit load S to the conveyor means F ensues at every division t or at a respectively whole multiple of the division t of the conveyor means F. The transfer of the unit load S can also be potentially adapted to a non-uniform division of the conveyor means F by varying the speed m of the drum T.

The above-described apparatus for separating and transferring unit loads from a stack to a conveying means may lead to a downstream circulating impeller wheel with cells for receiving the individual unit loads. The cells may accept unit loads S incoming from the conveyor means F and, after a corresponding rotation of The above-described apparatus for separating and transferring unit loads from a stack to a conveying means may lead to a downstream circulating impeller wheel with cells for receiving the individual unit loads. The cells may accept unit loads S incoming from the conveyor means F and, after a corresponding rotation of the impeller wheel, deliver the unit loads S to unit load carriers of a sorting means that circulate adjacent the impeller wheel.

Details of a suitable impeller wheel proceed, for example, from German Patent Application P 43 44 437.8. Details of a suitable sorting means are disclosed, for example, in German Patent Applications P 43 23 564.6 and P 43 23 565.4.

Although modifications and changes may be suggested by those skilled in the art, it is in the intention of the inventor to embody within the patent warranted hereon all changes and modifications as reasonably and properly come within the scope of this contribution to the art.

We claim:

1. An apparatus for separating and transferring flat unit loads selected from periodicals, newspapers, and letters to a conveyor, said apparatus comprising of first for accepting and transporting a plurality of said unit loads, which are oriented generally vertically in a horizontal path, to a fetching position at one end of the path; a drum mounted for rotation on a fixed axle above said conveyor and adjacent the fetching position, said drum having a perimeter surface with at least one suction opening provided therein, said drum having means for applying a suction to the suction opening as the opening moves in an arc from a first position starting at the fetching position to a second position over the conveyor; retractable stops movable from a stopping position preventing the unit load at the fetching station from contacting the suction opening to a retracted position allowing the suction opening to grasp the unit load at the fetching station; and control means to rotate the drum so that the suction opening grasps the unit load at the fetching station and lifts the unit load up off of the first means to move in said arc to the second position for discharge onto the conveyer, said arc having a length of between 180° and 270° so that the unit load is carried at least through one-half turn of the drum.

2. An apparatus according to claim 1, wherein the first means comprises a belt conveyor intermittently movable step-by-step toward said fetching position.

3. An apparatus according to claim 1, wherein the retractable stops are two bar members mounted for rotation on an axis, said perimeter surface of the drum has two circumferential depressions spaced to receive said two bars as the stops are rotated to the retracted position with the surfaces of the bars being below the perimeter surface of the drum.

4. An apparatus according to claim 1, wherein said means for applying a suction to the suction opening includes the axle having a suction passage with a radial opening communicating with a passage connected to the suction opening for the arcuate distance of said arc to form a slide valve.

5. An apparatus according to claim 1, wherein the control means controls a relative speed of rotation of said drum to a linear conveyor speed of the conveyor so that a plurality of unit loads are transferred one-by-one from said first means onto the conveyor with a predetermined spacing.

6. An apparatus according to claim 1, wherein the control means includes a sensor associated with said drum for sensing the position of each of the unit loads being transferred by the drum.

7. An apparatus according to claim 6, wherein said sensor is further adapted to determine slippage of each of the unit loads being transferred by the drum, and said control means adjusts the drum speed to compensate for any slippage.

8. An apparatus for separating and transferring flat unit loads selected from periodicals, newspapers, and letters to a conveyor, said apparatus comprising first means for accepting and transporting a plurality of said unit loads which are oriented generally vertically in a horizontal path to a fetching position at one end of the path; a drum mounted for rotation on a fixed axle above said conveyor and adjacent the fetching position, said drum having a perimeter surface with at least one suction opening provided therein, said drum having means for applying a suction to the suction opening as the opening moves in an arc from a first position starting at the fetching position to a second position over the conveyor; retractable stops movable from a stopping position preventing the unit load at the fetching station from contacting the suction opening to a retracted position allowing the suction opening to grasp the unit load at the fetching station; means to rotate the drum so that the suction opening grasps the unit load at the fetching station and lifts the unit load up off of the first means to move in said arc to the second position for discharge onto the conveyor, said arc having a length of between 180° and 270° so that the unit load is carried at least through one-half turn of the drum; and guide means associated with said drum for guiding the unit load being carried along said arc.

9. An apparatus according to claim 8, wherein the guide means comprises an endless circulating belt having a portion in contact with said perimeter surface of the drum at a portion less than the length of said arc.

10. An apparatus according to claim 9, wherein the retractable stops comprise a pair of spaced apart bars mounted for rotation, a peripheral surface of the drum having two circumferential compressions of a depth for receiving said bars when the bars are in the retracted position so that the bars are below the peripheral surface of the drum to enable the suction openings to grasp the unit load at the fetching position.

11. An apparatus according to claim 10, wherein said means for applying a suction to the suction opening includes the axle having a suction passage with a radial opening communicating with a passage connected to the suction opening for the arcuate distance of said arc to form a slide valve.

* * * * *